US007013685B2

(12) United States Patent
Francke

(10) Patent No.: US 7,013,685 B2
(45) Date of Patent: Mar. 21, 2006

(54) COMPUTER PHYSICAL SECURITY DEVICE WITH RETRACTABLE CABLE

(75) Inventor: Justin Francke, San Mateo, CA (US)

(73) Assignee: ACCO Brands USA LLC, Lincolnshire, IL (US)

( * ) Notice: Subject to any disclaimer, the term of this patent is extended or adjusted under 35 U.S.C. 154(b) by 0 days.

(21) Appl. No.: 10/897,569

(22) Filed: Jul. 22, 2004

(65) Prior Publication Data

US 2005/0039503 A1 Feb. 24, 2005

Related U.S. Application Data

(60) Provisional application No. 60/489,692, filed on Jul. 23, 2003.

(51) Int. Cl.
*E05B 73/00* (2006.01)

(52) U.S. Cl. ..... 70/18; 70/30; 70/49; 70/58

(58) Field of Classification Search ..... 70/18, 70/30, 49, 58, 14, 233, 456 R
See application file for complete search history.

(56) References Cited

U.S. PATENT DOCUMENTS 3,859,826 A * 1/1975 Singer et al. ..... 70/58
4,651,544 A * 3/1987 Hungerford ..... 70/63
4,756,171 A * 7/1988 Homar ..... 70/18
4,869,082 A * 9/1989 Appelbaum ..... 70/63
4,969,342 A * 11/1990 Marchiori ..... 70/49
5,473,917 A * 12/1995 Say ..... 70/49
5,502,989 A * 4/1996 Murray et al. ..... 70/58
5,768,920 A * 6/1998 DeBevoise ..... 70/18
5,960,652 A * 10/1999 Marmstad ..... 70/49
6,000,252 A * 12/1999 Murray et al. ..... 70/58
6,006,557 A * 12/1999 Carl et al. ..... 70/58
6,321,579 B1 * 11/2001 Reyes ..... 70/58
6,526,785 B1 * 3/2003 Asenstorfer et al. ..... 70/49
6,578,394 B1 * 6/2003 Yin ..... 70/58
6,581,421 B1 * 6/2003 Chmela et al. ..... 70/58
6,601,416 B1 * 8/2003 Sanders ..... 70/58
6,681,603 B1 * 1/2004 Yu ..... 70/18

* cited by examiner

*Primary Examiner*—Lloyd A. Gall
(74) *Attorney, Agent, or Firm*—Brian N. Young; Townsend and Townsend and Crew, LLP

(57) ABSTRACT

A device that includes a cable with a locking device/head at the end of the cable. The cable is coupled to a housing and is retractable into the housing for easy storage and portability. The locking device is stored within a compartment such that is flush with or with the housing. If keys are used with the lock, preferably the keys may be stored within the housing when the device is not in use.

33 Claims, 7 Drawing Sheets

COMPUTER PHYSICAL SECURITY DEVICE WITH RETRACTABLE CABLE

CROSS-REFERENCES TO RELATED APPLICATIONS

This application claims priority from now abandoned U.S. Provisional Patent Application No. 60/489,692 filed Jul. 23, 2003 entitled COMPUTER PHYSICAL SECURITY DEVICE WITH RETRACTABLE CABLE, which is hereby incorporated by reference, as if set forth in full in this document, for all purposes.

BACKGROUND OF THE INVENTION

The present invention generally relates to locking devices, and more specifically, to a locking device that includes a retractable cable.

A user may have many different portable electronic devices. For example, portable electronic devices may be laptop computers, portable digital assistants (PDAs), desktop computers, flat screen TVs, Blackberry devices, Goodlink devices, digital cameras, portable music players (e.g., IPODs), etc. These devices are typically small but very expensive. When left unattended, electronic devices are easily stolen, and because of their expensive nature, there may be a higher likelihood that they are stolen. Accordingly, security devices have been developed in order to prevent theft of these devices.

The security devices often include a cable or tether. The cable or tether is typically looped around a stationary object in order to secure the security device to the stationary object. When the cable is not in use, the cable is coiled for easier storage. Generally, a user coils the cable, and often, the coiled cable is not compact and becomes uncoiled or tangled with other devices. Also, the coiled cable may be bulky and hard to carry.

Accordingly, an improved security device is desired.

BRIEF SUMMARY OF THE INVENTION

The present invention generally relates to a security device that includes a retractable cable. In one embodiment, the security device is for locking a portable electronic device. The security device comprises a locking device, a cable coupled to the locking device, and a housing including a retracting mechanism. The retracting mechanism is configured to enable the cable to be extended such that the locking device is extended from the housing. The cable is looped around a stationary object and the locking device can then be attached to the portable electronic device. The portable electronic device is then secured. The locking device may be unlocked and unattached from the portable electronic device. The retracting mechanism is then configured to retract the cable into the housing. Thus, the locking device is also retracted. In one embodiment, the locking may be retracted such that it is flush with or within an outer surface of the housing.

In one embodiment, a security device for a portable electronic device is provided. The security device comprises: a locking device; a cable coupled to the locking device; a housing including a retracting mechanism, wherein the retracting mechanism is configured to enable the cable to be extended such that the locking device is extended from the housing and can be attached to the portable electronic device in such a way to inhibit theft of the portable electronic device, wherein the retracting mechanism is further configured to retract the cable into the housing.

In another embodiment, a system for securing a portable electronic device is provided. The system comprises: a portable electronic device, the portable electronic device including a slot; a security device, the security device comprising: a locking device; a cable coupled to the locking device; and a housing including a retracting mechanism, wherein the retracting mechanism is configured to enable the cable to be extended such that the locking device is extended from the housing and can be attached to the slot of the portable electronic device in such a way to inhibit theft of the portable electronic device, wherein the retracting mechanism is further configured to retract the cable into the housing.

In yet another embodiment, a method for locking a portable electronic device is provided. The method comprises: providing a security device comprising a housing that includes a cable and locking device that are retractable into the housing; extending the locking device and the cable from the housing of the security device; attaching the locking device to the portable electronic device; and locking the locking device, wherein theft of the portable electronic device is inhibited; unlocking the locking device; and retracting the locking device and the cable into the housing.

A further understanding of the nature and the advantages of the inventions disclosed herein may be realized by reference of the remaining portions of the specification and the attached drawings.

DETAILED DESCRIPTION OF THE INVENTION

Figure 1A:
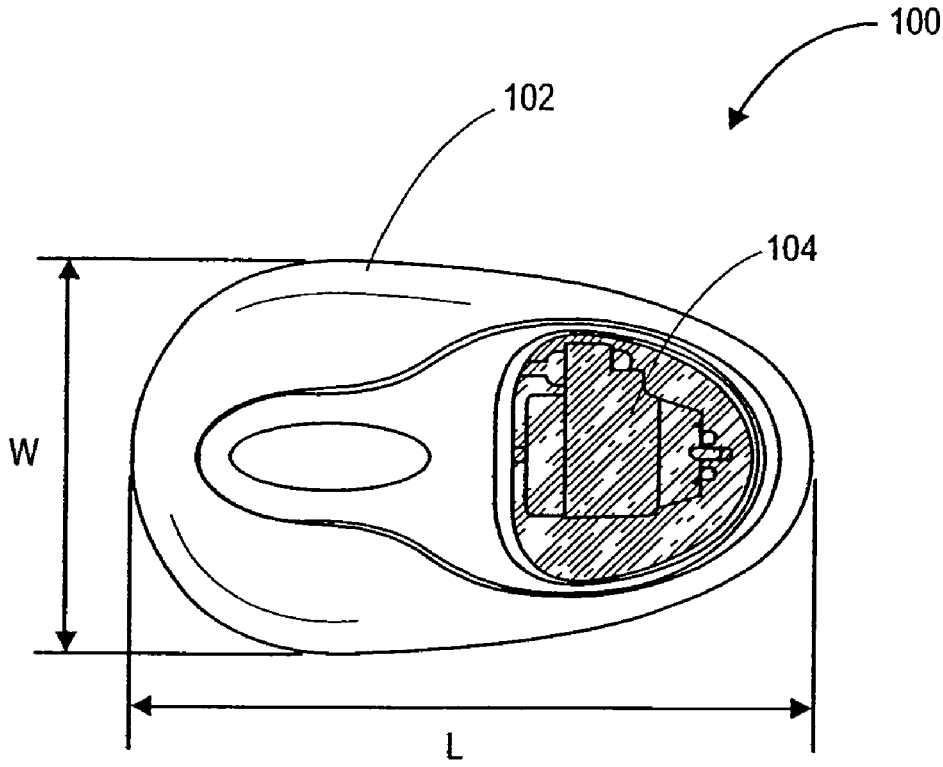
FIGS. 1A and 1B depict various views of a security device according to one embodiment of the present invention.
Figure 1B:
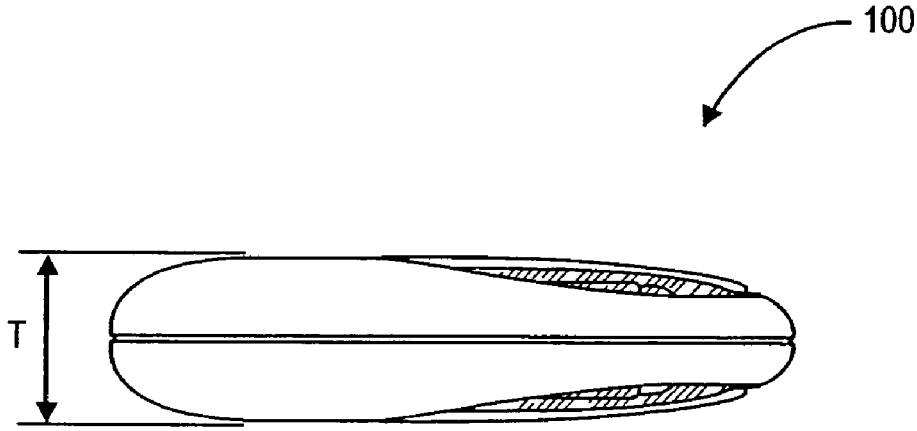

FIGS. 1A and 1B depict various views of a security device 100 according to one embodiment of the present invention. As shown, security device 100 includes a housing 102 and a locking device 104. In one embodiment, housing 102 is made from a sturdy material such a plastic or a metal. A person skilled in the art will understand that other materials may be used. In one embodiment, housing 102 is made from a material such that it may be hard to break the material. The material should be hard to break because, as will be described below, housing 102 may be used in securing a portable electronic device.

In one embodiment, housing 102 provides a very thin design. For example, a length L may be up to 13 centimeters, a width W may be up to 10 centimeters, and a thickness T up to 7.25 centimeters. Also, security device 100 may weigh approximately 3.75 lbs. Although these dimensions are described, it will be understood that a person skilled in the art will also appreciate other dimensions for housing 102.

In one embodiment, locking device 104 is configured to be attached to a portable electronic device. A portable electronic device includes a laptop computer, desktop computer, PDA, Blackberry device, cellular phone, digital camera, flat screen monitor, television, portable music player etc. It will be understood that the person skilled in the art will appreciate other portable electronic devices that may be used. The portable electronic devices may be primarily mobile or stationary. For example, a cellular phone is primarily mobile in that it is moved around. A flat screen television may be primarily stationary because it is not moved often. The television, however, may be moved and thus may need to be secured from theft using a security device 100.

In one embodiment, locking device 104 is configured to be attached to a portable electronic device using a security slot (which preferably has dimensions of about 3 mm by about 7 mm and is generally rectangular in shape). The portable electronic device includes a security slot in which locking device 104 is inserted. Locking device 104 is then locked to the security slot. The process of locking device 104 to a portable electronic device will be described in more detail below.

As shown in FIGS. 1A and 1B, locking device 104 is enclosed in housing 102. Accordingly, security device 100 provides a compact structure when locking device 104 is not in use. In one embodiment, locking device 104 may be flush with an outer surface of housing 102. Thus, locking device 104 is found within housing 102.

Figure 2:
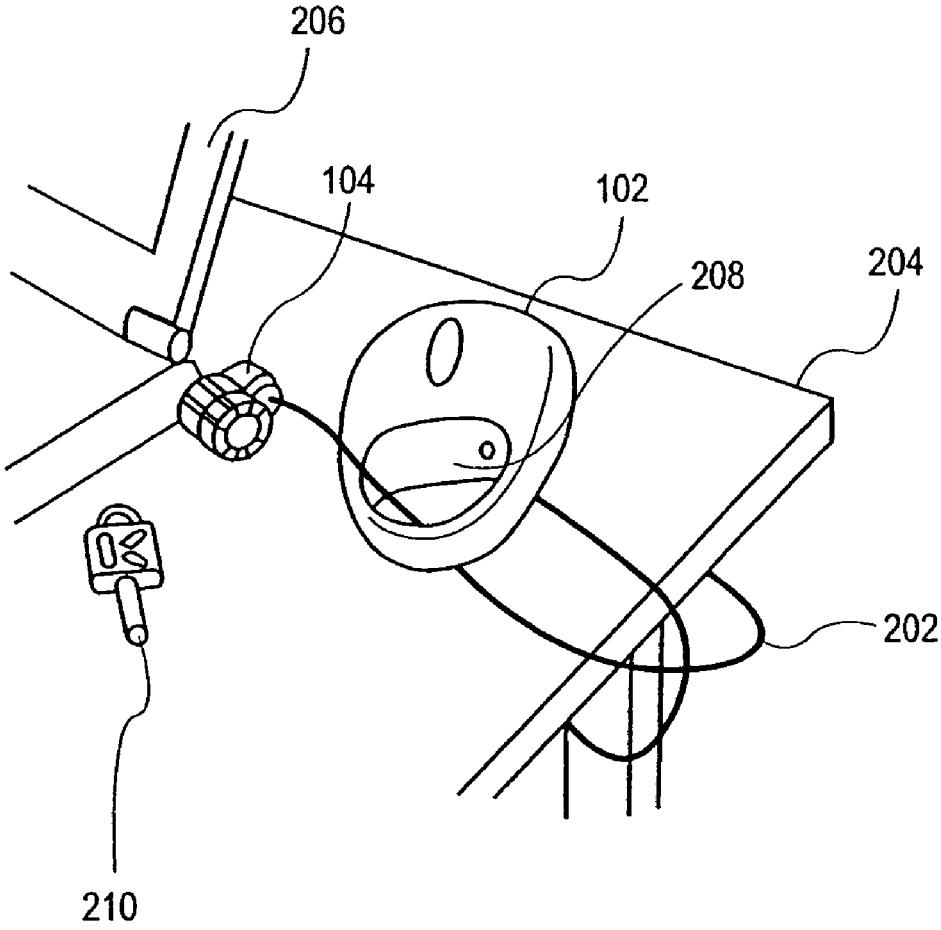
FIG. 2 depicts an additional view of an embodiment of the security device.

FIG. 2 depicts an additional view of an embodiment of security device 100. Security device 100 is shown with locking device 104 extended from housing 102. Locking device 104 is coupled to a cable 202, which is coupled to housing 102. A retracting mechanism (not shown) is included in housing 102 and is coupled to cable 202.

In one embodiment, cable 202 may be made from a strong material. For example, cable 202 may be formed from steel, any other metal, or any other material (e.g., a cable made from Kevlar™ fibers or poly p-phenyleneterephthamide fibers). In addition, cable 202 may include a cable coating such as a PVC cable coating. The diameter of cable 202 may be 1.5 mm without the PVC coating and 2.5 mm with the PVC coating. Cable 202, in one embodiment, may withstand at least 200 lbs. of pull force. Cable 202 may be of a variable length but may be four feet in length in one embodiment. Although these characteristics are mentioned, it will be understood that cable 202 may have other characteristics, such as cable 202 may have a different thickness.

As shown, locking device 104 and cable 202 have been extended from housing 102. In one embodiment, a button may be provided such that, when pushed, it allows cable 202 and locking device 104 to be extended. When the button is released, the cable is locked in that it cannot be extended anymore. When the button is pushed again, cable 202 and locking device 104 may be retracted into housing 102. A person skilled in the art will appreciate other methods of using devices to extend and retract cable 202. For example, the button may be any release mechanism that allows extension of cable 202 and causes retraction of cable 202. In one embodiment, a slidable button may be provided that slides to a position that allows extension of cable 202 and slides to a position that causes retraction of cable 202.

As cable 202 and locking device 104 are extended from housing 102, they may be looped around an object 204. In one embodiment, object 204 may be a stationary object. Locking device 104 and cable 202 may then be passed through a compartment 208 in housing 102. Locking device 104 is attached to a portable electronic device 206 and locked to portable electronic device 206. In one embodiment, locking device 104 may be locked (or unlocked) using key 210, a combination, or any other locking mechanism.

By looping locking device 104 and cable 202 around a fairly stationary object 204 and through compartment 208, locking device 104 may be attached to portable device 206 in a secure manner. If a user attempts to move portable device 206, security device 100 restricts the movement of portable device 206. Accordingly, a user may not be able to remove portable device 206 from the area in which it has been locked. Although passing locking device 104 though compartment 208 is described, it will be recognized that other methods of securing portable electronic device 206 may be used. For example, a second loop on housing 102 may be provided such that locking device 104 is passed through the second loop. Also, a loop on cable 202 may be provided such that locking device 104 is passed through the loop.

Figure 3A:
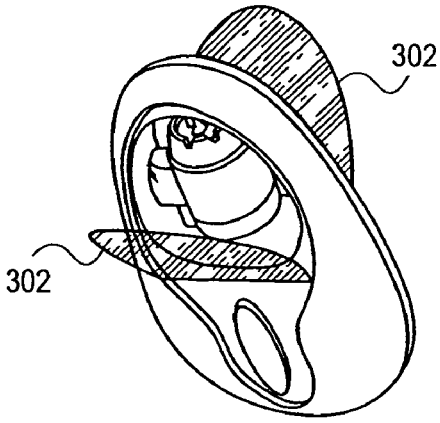
FIGS. 3A, 3B, and 3C depict various views of the security device according to one embodiment of the present invention.
Figure 3B:
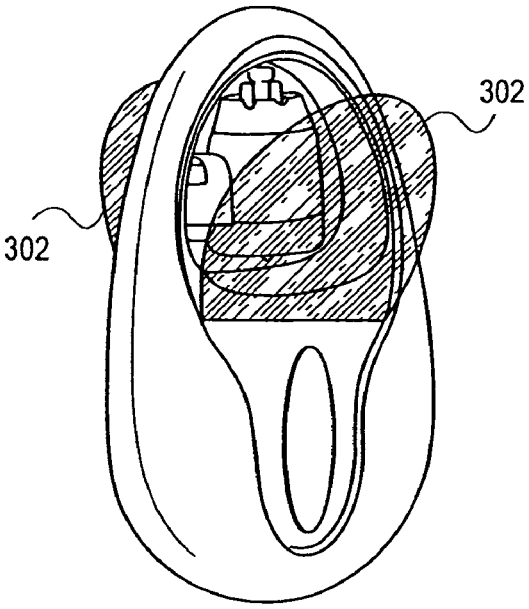
Figure 3C:
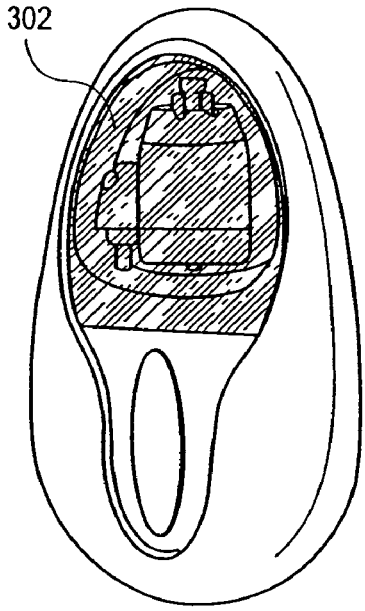

FIGS. 3A, 3B, and 3C depict various views of security device 100 according to one embodiment of the present invention. As shown, locking device 104 and cable 202 are in a retracted position.

Locking device 104 and cable 202 may be retracted into housing 102 by various methods. For example, a button may be provided that, when pushed or unpushed, may cause a retracting mechanism to retract locking device 104 and cable 202 into housing 102. Additionally, retracting mechanism may be activated to retract cable 202 and locking device 104 into housing 102 by pulling slightly on cable 202 when cable 202 is in a stationary position.

As shown, locking device 104 and cable 202 are enclosed within housing 102. In one embodiment, cable 202 is wound around a retracting mechanism in housing 102. Cable 202 is thus compactly stored in housing 102.

Locking device 104 is additionally found within housing 102. In one embodiment, locking device 104 is substantially flush with an outer surface of housing 102. Also, covers 302 may be included in the security device 100. Covers 302 may open and close.

When closed, covers 302 enclose housing 102 such that locking device 104 is completely enclosed within housing 102. FIG. 3C depicts embodiment of security device 100 with covers 302 closed. As shown, security device 100 is in a very compact form.

Although covers 302 are shown as being included with security device 100, it will be understood that covers 302 may not be included in security device 100. Rather, locking device 104 and cable 202 may be located within housing 102 without covers. For example, FIG. 2 depicts a security device 100 without covers 302.

Figure 4:
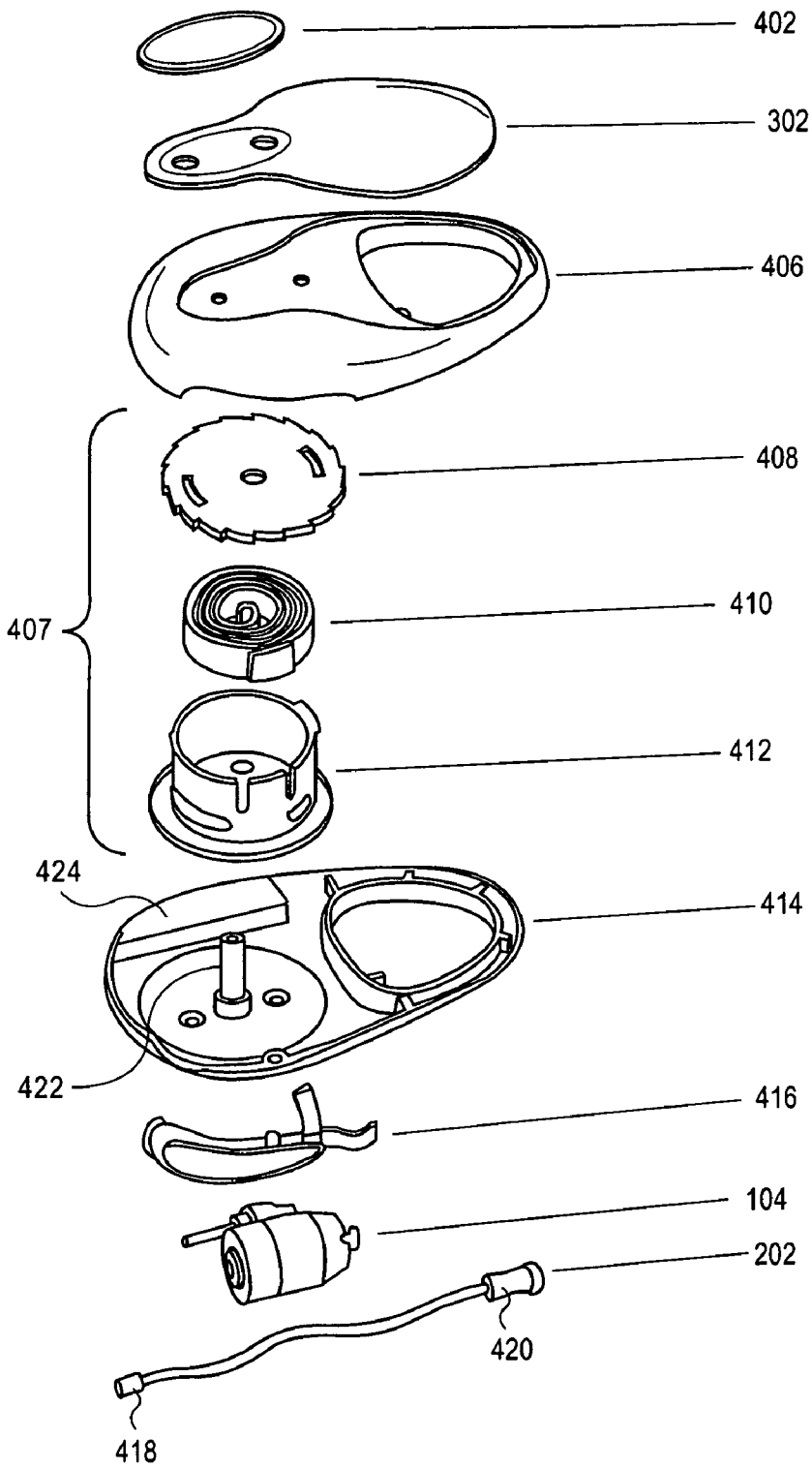
FIG. 4 shows an exploded view of the security device according to one embodiment of the present invention.

FIG. 4 shows an exploded view of security device 100 according to one embodiment of the present invention. Housing 102 may be formed from a clamshell design and include the first outer cover 406 and a second outer cover 414. Additionally, a cover 302 and logo area 402 may be attached to outer housing 406 or 414. Outer housing 406 and/or 414 may be made from a sturdy material, such as a plastic or metal.

A retracting device 407 includes a rotor 408, a coiling device 410, and a base 412. Although these parts are shown in the retracting mechanism 407, it will be understood that retracting mechanism 407 may include other parts or may be in a different form. Retracting mechanism 407 is configured to retract cable 202 and locking device 104 into housing 102.

Additionally, retracting mechanism 407 allows the extension of cable 202 and locking device 104 from housing 102.

In operation, cable 202 is wound around base 412. A spring may be included such that rotor 408 and coiling device 410 are turned thereby retracting cable 202 around base 412.

The assembly of security device 100 may include coupling cable 202 to retracting mechanism 407. In one embodiment, a first end 418 of cable 202 may be attached to base 412. A second end 420 may then be coupled to locking device 104. Any kind of adhesive may be used to attach first end 418 to base 412 and second end 420 to locking device 104.

Rotor 408, coiling device 410, and base 412 are then coupled together to form retracting mechanism 407. Second outer housing 414 may include a peg 422 that is configured to couple to retracting mechanism 407. Peg 422 is configured to be passed through an aperture that is formed in rotor 408, coiling device 410, and base 412. Peg 422 allows retracting mechanism 407 to spin around peg 422. It will be understood that peg 422 may be in other forms, such as any kind of device that may hold retracting mechanism 407 in housing 102.

First outer housing 406 and second outer housing 414 are then coupled together. In one embodiment, a clip 416 is used to secure first outer housing 406 and second outer housing 414 together. Outer cover 302 and logo area 402 may then be coupled to first outer housing 406. In one embodiment, screws may be used to attach cover 302 and logo area 402 to first outer housing 406. Also, any adhesive may be used, such as glue. Additionally, a storage area 424 in housing 102 may be provided such that keys or other items may be stored in housing 102.

A spring and retracting mechanism 407 is strong enough to fully retract locking device 104 and cable 202 into housing 102. In addition, locking device 104 and cable 202 may withstand at least 200 lbs. of pull force without pulling out of the housing 102.

Retracting mechanism 407 may be configured to withstand at least 1,000 cycles. A cycle may be extending the cable to full length, opening covers 302, looping the cable through the device, unlooping the cable 202, and retracting cable 202. Although a 1,000 cycles are mentioned, it will be understood that the retracting mechanism 407 may withstand any number of cycles.

Figure 5C:
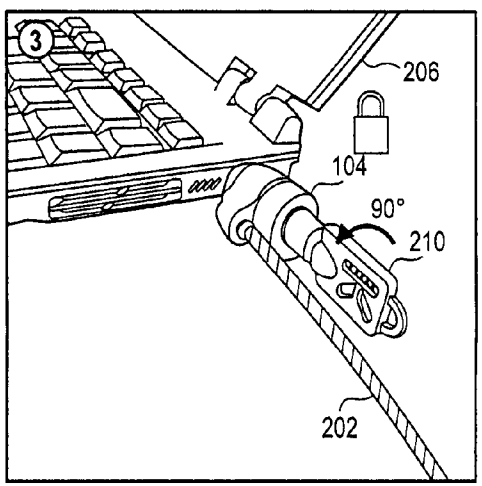
FIGS. 5A–5E depict a method of securing a portable device using the security device according to one embodiment of the present invention.
Figure 5B:
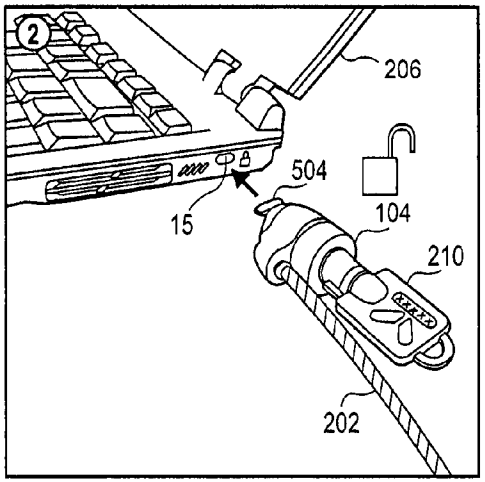
Figure 5A:
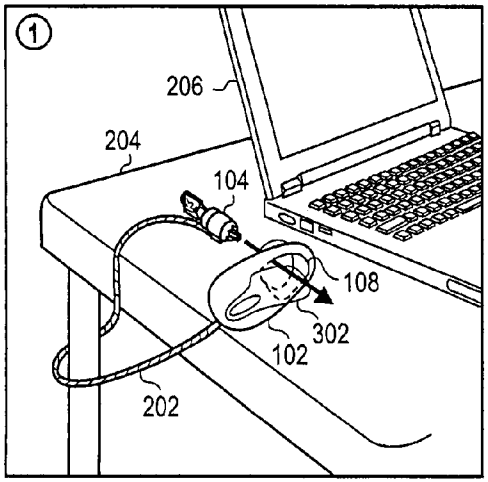

FIGS. 5A–5E depict a method of securing a portable device 206 using security device 100 according to one embodiment of the present invention. As depicted in FIG. 5A, cable 202 is extended from housing 102. Locking device 104 and cable 202 is then looped around object 204. In this case, object 204 is a table and more specifically, a leg of a table. However, locking device 104 and cable 202 may be looped around other devices, such as looped under a table and through a hole in the table, a chair, or any other fairly immovable object.

Locking device 104 and cable 202 are then looped through compartment 208. In one embodiment, compartment 208 is a compartment that stored locking device 104 when it was not in use. In one embodiment, covers 302, are opened to allow locking device 104 and cable 202 to be inserted through compartment 208. In other embodiments, security device 100 does not include covers.

In FIG. 5B, locking device 104 is inserted into a slot 15 in portable device 206. Locking device 104 includes a spindle 504 that is configured to be inserted into slot 15. The locking of locking device 104 in slot 15 will be described in more detail below. As shown, a key 210 has been inserted into locking device 104. This position is an unlocked position for locking device 104.

FIG. 5C depicts locking device 104 as it is locked to portable device 106. In one embodiment, locking device 104 is inserted into slot 15. Key 210 is then turned. When key 210 is turned a certain amount, cross-member 504 such as a T-shaped cross member is misaligned with slot 15. Misaligning cross-member 504 with an inner surface of portable device 106 thereby inhibits removal of locking device 104 from portable electronic device 206. Cross-member 504 is turned such that it cannot be removed from slot 15 without being returned to its original position. Accordingly, removing locking device 104 from slot 15 is restricted. Other types of locking devices that are suitable for use in embodiments of the invention are described below.

Figure 5E:
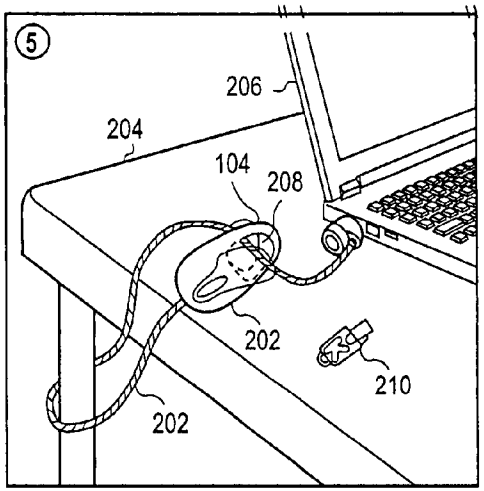
Figure 5D:
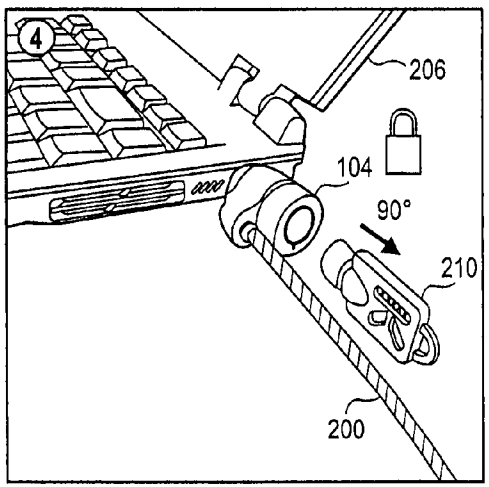

In FIG. 5D, key 210 is removed from locking device 104. Locking device 104 cannot be removed from portable device 206 without using key 210.

FIG. 5E depicts locking device 104 being attached to portable device 206. As shown, cable 202 has been looped around object 204, through compartment 208 and attached to portable device 206. If a user tries to move portable device 206, the movement is restricted by cable 202. Accordingly, theft of portable device 206 may be restricted using security device 100.

Accordingly, security device 100 provides a retractable, portable security lock. The cable is easy to retract and enables portability and mobility while providing security. The housing may form part of the locking mechanism and thus performs a dual function. The small compact lock design is designed for portable devices and may not block other ports. The locking device also provides superior locking strength when attached to a slot 15 in a portable electronic device 206.

Figure 6:
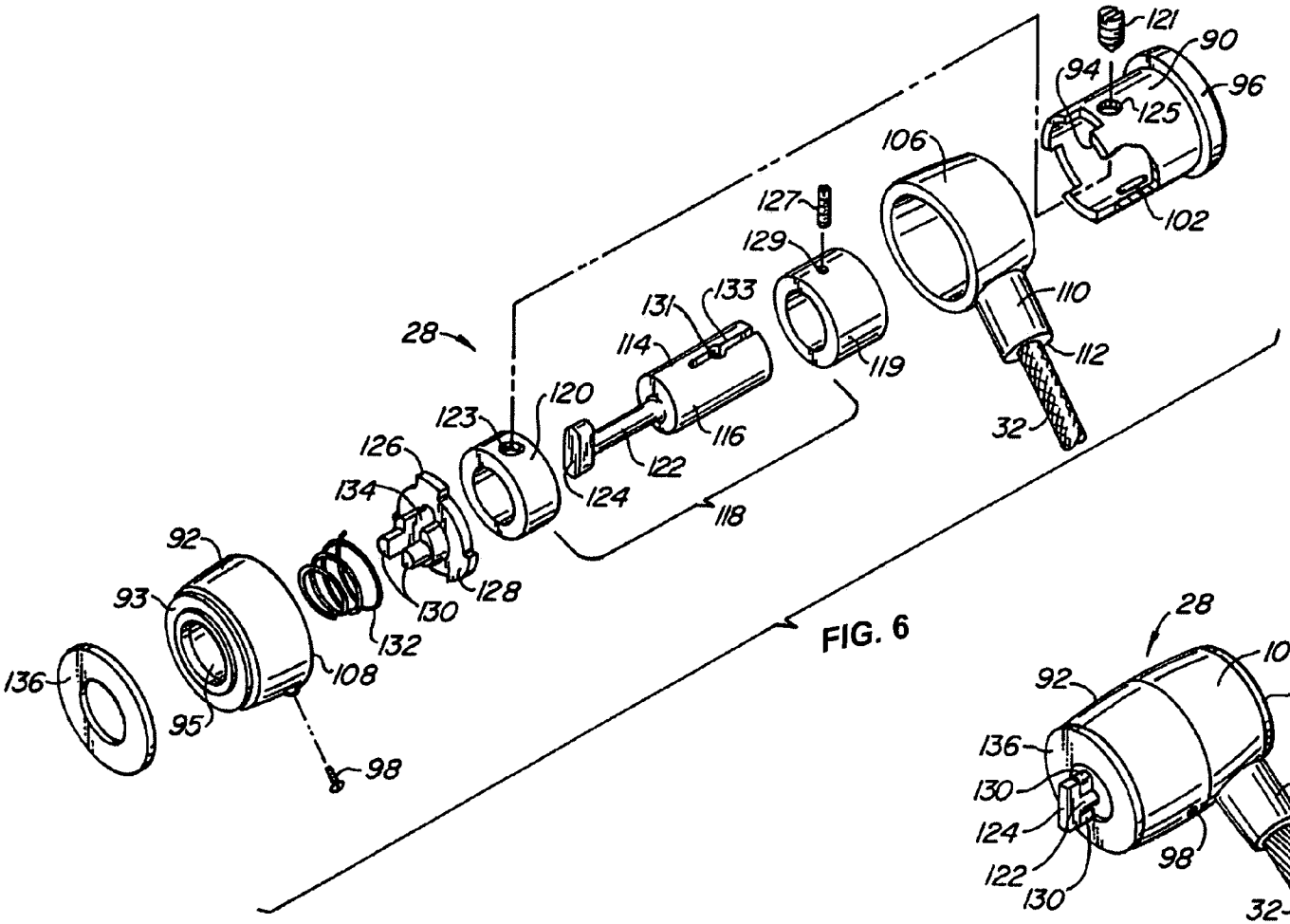
FIGS. 6, 7, 8A and 8B depict various views of a locking device according to one embodiment of the present invention.
Figure 7:
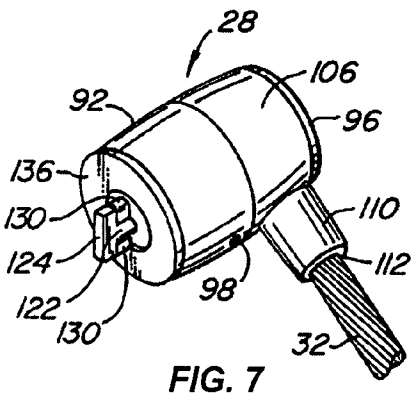

Different embodiments of locking devices 104 will now be described. Locking device 104 may be provided in many forms. A suitable locking device 28 is shown in FIG. 7 and the exploded view of FIG. 6. Locking device 28 includes a hollow shell 90 and a nose-piece 92 which, in combination, form a housing. Shell 90 has a hollow cylindrical interior cavity 94, and an integral apertured plate 96 at one end. A pin 98 is inserted through an aperture (not shown) in nose-piece 92 to engage a slot 102 in shell 90. Pin 98 is designed to shear when torque is applied to nose-piece 92 so that an unauthorized attempt to remove the attachment mechanism will simply shear the pin and allow the nose-piece to freely rotate without degrading the attachment of the locking device to the component to be protected. Slot 102 is axially elongate so that limited axial movement is allowed between shell 90 and nose-piece 92. The forward end of nose-piece 92 has a plate 93 having a central aperture 95.

A cylindrical collar 106 circumscribes the outer portion of shell 90 and occupies the slot laterally defined by plate 96 and the aft surface 108 of nose-piece 92. Collar 106 has an integral tab 110 with an aperture 112 adapted to receive one end of cable 32. Cable 32 is dead-ended into tab 110 and attached so that it cannot be removed.

A spindle 114 has a cylindrical portion 116 adapted to be received within a cylindrical lock 118 in shell 90. Cylindrical lock 118 includes a front cylinder 119, and a back cylinder 120. A blunt pin or set screw 121 is inserted through an aperture 125 in shell 90, and through a corresponding aperture 123 in back cylinder 120, to lock the front cylinder rotationally with respect to shell 90. Correspondingly, pin or set screw 127 engages a relatively smaller aperture 129 in front cylinder 119, and a widening 131 in slot 133 in the cylindrical portion 116 of spindle 114. Front cylinder 119 is thus fixed rotationally With respect to spindle 114.

As with conventional cylindrical locks, a plurality of pins normally span the interface between front cylinder 119 and back cylinder 120 so that the cylinders are rotationally locked together, thus preventing relative rotation between locking shell 90 and spindle 114. However, a key 210 is insertable through the apertured plate 96 of shell 90 to engage front cylinder 119. The correct key 210 will have bosses located to depress the pins passing between cylinders 119 and 120 so that such pins do not span the interface between the cylinders, allowing the cylinders to rotate with respect to one another. In this fashion, spindle 114 can be rotated with respect to shell 90 only upon insertion and rotation of the appropriate key 210.

Spindle 114 also includes a shaft 122, and a crossmember 124 at the free end of the shaft. An abutment mechanism 126 has an abutment plate 128 adapted to fit within nose-piece 92, and a pair of pins 130 adapted to extend outwardly through aperture 95. A spring 132 is located between abutment plate 128 and nose-piece 92 to bias the cylindrical portion 116 of spindle 114 and the abutment plate rearwardly. Abutment plate 126 has an elongate aperture 134 which allows crossmember 124 to extend through the aperture plate. A plastic bushing 136 is fixed to the surface of plate 93 so that the mechanism does not scar the equipment to which it is attached.

Figure 8A:
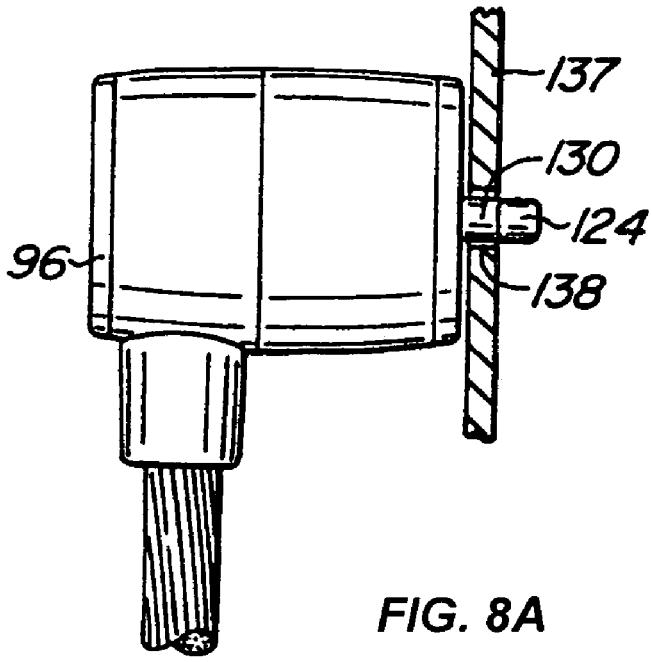
Figure 8B:
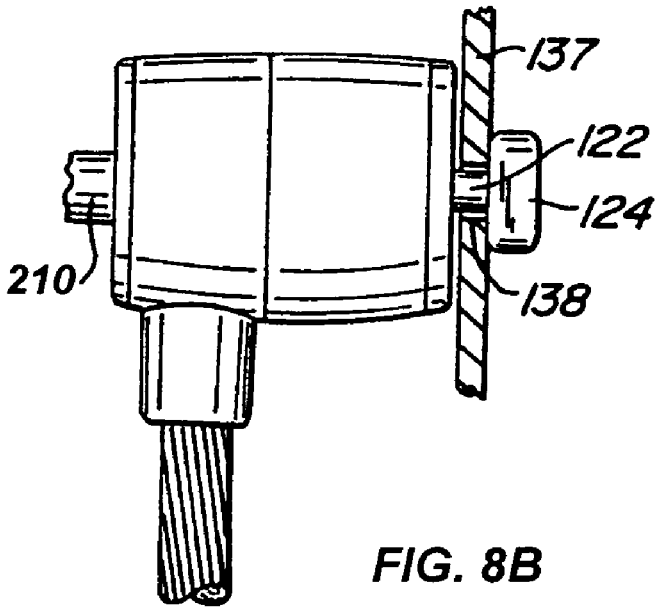

The insertion of locking device 28 into the exterior wall 137 of a piece of equipment is illustrated by way of reference to FIGS. 8A and 8B. Wall 136 has a slot 138. The peripheral dimensions of crossmember 124, and also those of pins 130 and shaft 122 in combination, is that the crossmember is generally rectangular, having straight sides and semi-circular ends. In the preferred embodiment, the long dimension of the crossmember 124 is 6.75 millimeters, while the short dimension is 2.75 millimeters, each being slightly less than the corresponding dimension of slot 138. The peripheral dimensions of the pins 130 and shaft 122 also closely conform to the interior dimensions of slot 138. As with crossmember 124, pins 130 in shaft 122 have a long dimension of 6.75 millimeters, and a short dimension of 2.75 millimeters. Simply put, locking device 28 is designed to fit into the same slot as locking device 12.

As illustrated in FIG. 8A, crossmember 124 is aligned with pins 30 so that the crossmember can be inserted into slot 138. When fully inserted, the space in the slot is essentially occupied by pins 130 and shaft 122. If necessary, plate 96 can be depressed to push the cylindrical portion of spindle 114 against spring 132. Once crossmember 124 has been fully inserted through slot 138, a key 140 engaging lock mechanism (see FIG. 7) is used to rotate the spindle 90 degrees and misalign crossmember 124 and slot 138.

In operation, both locking device 12 and locking device 28 are attached to an item of computer or other equipment which has a specially designed slot 138. First, the crossmember 124 is aligned with the pins 130, for insertion to the crossmember through the slot. The spindle 114 is then rotated relative to the housing to misalign the crossmember 124 relative to the slot. The spindle is locked in this configuration by passing the cable through the mating slot in a first embodiment, or using the key 210 in the second embodiment. Either way, the locking device is extremely difficult to disengage by anyone not having the appropriate key 210. Any unauthorized attempt to remove the locking device from the computer component will most likely result in significant damage to the computer housing, making the computer difficult to resell and greatly reducing its theft potential.

Other embodiments of locking device 104 are further described in U.S. Pat. No. 6,006,557 and U.S. Pat. No. 5,502,989. Also, in another example, in U.S. Pat. No. 6,321,579, a locking device 104 may include tabs and a hook arm. The tabs and hook arm are configured to be inserted into a slot. Once inserted into the slot, the hook arm may be pivoted such that it latches onto an inside surface of the slot. Accordingly, the locking device is secured within the slot and cannot be removed. Another locking device is described in U.S. Pat. No. 6,591,642. This locking device includes an L-shaped hook that is inserted into a security slot in a portable electronic device. A user then pushes a button or cylinder at the end of the device to push out a bolt to fill the security slot and thereby secure the locking device to the portable electronic device.

In order to unlock the locking device, the hook arm is pivoted in an opposite direction such that the hook arm is unlatched from the inside surface of the slot. The locking device may then be removed.

Embodiments of the invention provide a number of advantages. First, embodiments of the invention provide a user with a neat and clean way to store a security device for a portable device. This is especially useful for users who are traveling and do not want to have long cables unbundled and chaotically stored within a briefcase or suitcase. Second, embodiments of the invention provide a one-piece solution to address a number of problems. For example, as shown above, the housing can be both used to store a cable and locking device for a security device and can be used as part of the security device when the security device is being used to lock down a portable device. Separate devices for storing a cable and a locking device, and for providing a locking function are not needed in embodiments of the invention. Consequently, embodiments of the invention provide the user with a compact and efficient way to lock down a portable device.

All of the above patents, patent applications, and publications are herein incorporated by reference in their entirety for all purposes as if present in this application. None is admitted to be prior art to the present application.

The above description is illustrative but not restrictive. Many variations of the invention will become apparent to those skilled in the art upon review of the disclosure. The scope of the invention should, therefore, be determined not with reference to the above description, but instead should be determined with reference to the pending claims along with their full scope or equivalents.

What is claimed is:

1. A security device for a portable device, the security device comprising:

a locking device;

a cable coupled to the locking device, the locking device being at a distal end of the cable;

a housing including a retracting mechanism, wherein the housing comprises a compartment, the locking device configured to be stored in the compartment when the locking device is not in use, wherein the retracting mechanism is configured to enable the cable to be extended such that the locking device is extended from the compartment and looped through the compartment when locking the locking device to the portable device in such a way to inhibit theft of the portable device, wherein the retracting mechanism is further configured to retract the cable into the housing.

2. The security device of claim 1, wherein the locking device is substantially flush with the compartment when the cable is retracted into the housing.

3. The security device of claim 1, wherein the locking device is within the compartment when the cable is retracted in the housing.

4. The security device of claim 1, wherein the cable is coiled within the housing by the retracting mechanism.

5. The security device of claim 1, wherein the cable is retracted into the housing when the locking device is not in use.

6. The security device of claim 1, further comprising a key, the key usable to lock the locking device to the portable device.

7. The security device of claim 6, further comprising a key compartment within the housing, wherein the key fits within the key compartment.

8. The security device of claim 1 wherein the compartment is used for storing the locking device when the locking device and cable have been retracted into the housing.

9. The security device of claim 1, further comprising a key compartment within the housing, wherein a key fits within the key compartment.

10. The security device of claim 1, wherein the locking device is configured to lock to at least one of a laptop computer, desktop computer, portable digital assistant (PDA), Blackberry device, cellular phone, digital camera, flat screen monitor, television, and portable music player.

11. The security device of claim 1, wherein the locking device is configured to lock to a slot in the portable device.

12. The security device of claim 1, wherein the housing comprises the dimensions (length, width, thickness) of up to 13 centimeters, 10 centimeters, and 7.25 centimeters.

13. The security device of claim 1, wherein the portable device comprises a portable electronic device.

14. A system for securing a portable device, the system comprising:

a portable device, the portable device including a slot;

a security device, the security device comprising:

a locking device;

a cable coupled to the locking device, wherein the locking device is at a distal end of the cable; and a housing including a retracting mechanism, wherein the housing comprises a compartment, the locking device configured to be stored in the compartment when the locking device is not in use, wherein the retracting mechanism is configured to enable the cable to be extended such that the locking device is extended from the compartment and looped through the compartment when locking the locking device to the slot of the portable device in such a way to inhibit theft of the portable device, wherein the retracting mechanism is further configured to retract the cable into the housing.

15. The system of claim 14, further comprising a key, the key configured to lock the locking device.

16. The system of claim 15, further comprising a key compartment within the housing, wherein the key fits within the key compartment.

17. The system of claim 14, further comprising a stationary object, wherein the cable is looped around the stationary object in such a way to inhibit theft of the portable device.

18. The system of claim 14, wherein the locking device is substantially flush with the compartment when the cable is retracted into the housing.

19. The system of claim 14, wherein the locking device is within the compartment when the cable is retracted in the housing.

20. The system of claim 14, wherein the cable is retracted into the housing when the locking device is not in use.

21. The system of claim 14, wherein the portable device comprises a portable electronic device.

22. The system of claim 14, wherein the compartment is used for storing the locking device when the locking device and cable have been retracted into the housing.

23. The system of claim 14, wherein the portable device comprises at least one of a laptop computer, desktop computer, portable digital assistant (PDA), Blackberry device, cellular phone, digital camera, flat screen monitor, television, and portable music player.

24. The system of claim 14, wherein the housing comprises the dimensions (length, width, thickness) of up to 13 centimeters, 10 centimeters, and 7.25 centimeters.

25. A method for locking a portable device, the method comprising:

providing a security device comprising a housing that includes a cable and locking device that are retractable, the locking device being at a distal end of the cable, wherein the housing comprises a compartment, the locking device configured to be stored in the compartment when the locking device is not in use;

extending the locking device and the cable from the compartment of the security device;

looping the locking device through the compartment:

attaching the locking device to the portable device; and locking the locking device, wherein theft of the portable device is inhibited.

26. The method of claim 25, wherein the locking device is retracted such that it is substantially flush with the compartment.

27. The method of claim 26, wherein the locking device is retracted such that it is fully within the compartment.

28. The method of claim 25, further comprising placing keys in a key compartment found in the housing.

29. The method of claim 25, further comprising looping the locking device and cable around a stationary object.

30. The method of claim 25, wherein the portable device comprises a portable electronic device.

31. The method of claim 25, wherein the portable device comprises at least one of a laptop computer, desktop computer, portable digital assistant (PDA), Blackberry device, cellular phone, digital camera, flat screen monitor, television, and portable music player.

32. The method of claim 25, wherein the housing comprises the dimensions (length, width, thickness) of up to 13 centimeters, 10 centimeters, and 7.25 centimeters.

33. The method of claim 25, further comprising:

unlocking the locking device; and retracting the cable into the housing and the locking device into the compartment.

* * * * *